United States Patent [19]

Yoon et al.

[11] Patent Number: 4,655,896

[45] Date of Patent: Apr. 7, 1987

[54] APPARATUS FOR FERRIC ION TREATMENT FOR REMOVAL OF ASH-FORMING MINERAL MATTER FROM COAL

[76] Inventors: Roe-Hoan Yoon; A. Dilo Paul, both of c/o VPI, Dept. of Mining, Blacksburg, Va. 24061-2899

[21] Appl. No.: 817,144

[22] Filed: Jan. 8, 1986

[51] Int. Cl.[4] ..... C10L 9/02; C25B 3/00; C25B 15/08

[52] U.S. Cl. ..... 204/263; 44/1 B; 44/1 SR; 204/131; 204/255

[58] Field of Search ..... 44/1 B, 1 A, 1 SR; 204/131, 238, 263, 130, 255

[56] References Cited

U.S. PATENT DOCUMENTS

| | | | |
|---|---|---|---|
| 4,153,531 | 5/1979 | Faul et al. | 204/263 |
| 4,239,613 | 12/1980 | Schulz | 44/1 B |
| 4,496,441 | 1/1985 | Sweeney et al. | 204/131 |
| 4,517,067 | 5/1985 | Byerley et al. | 204/255 |

FOREIGN PATENT DOCUMENTS

| | | | |
|---|---|---|---|
| 1159001 | 12/1983 | Canada | 44/1 B |

OTHER PUBLICATIONS

Paul, "Pretreatment of Coal . . . ", Brookhaven National Laboratory Informal Report 35429, Oct. 1984.

Guruswamy et al., "Pretreatment of Coal Slurries . . . "abstract, ACS 56 Symposium, Jun. 1982.

Okada et al., "On the Electrolysis of Coal Slurries"; J. Electrochem. Soc., Oct. 1981, pp. 2097–2102.

Farooque et al., I, "Anodic Coal Reaction . . . ", Nature, vol. 280, Aug. 23, 1979, pp. 666–668.

Farooque et al., II, "Electrochemical Gasification . . . ", Fuel, vol. 58, Oct. 1979, pp. 705–712.

Coughlin et al., "Hydrogen Production . . . ", Nature, vol. 279, May 1979, pp. 301–303.

*Primary Examiner*—Howard S. Williams

*Attorney, Agent, or Firm*—Nixon & Vanderhye

[57] ABSTRACT

By Ferric Ion Treatment of crushed and/or pulverized coal, the ash content of a coal can be significantly and efficiently reduced. This treatment of coal, preferably in an acidic medium, creates an increase in osmotic pressure inside the pores and crevices of the coal matrix until they open up, allowing the ash-forming mineral matter to be released from the coal. Also, the ferric ions preferentially attack the sessile bonds of the coal molecule and help open up the pores. The liberated mineral matter is then separated from the coal to obtain a clean coal. A flow-through reactor, utilizing working, reference and counter electrodes, and a loosely-packed coal bed through which the electrolyte flows, is particularly effective in facilitating the Ferric Ion Treatment.

6 Claims, 6 Drawing Figures

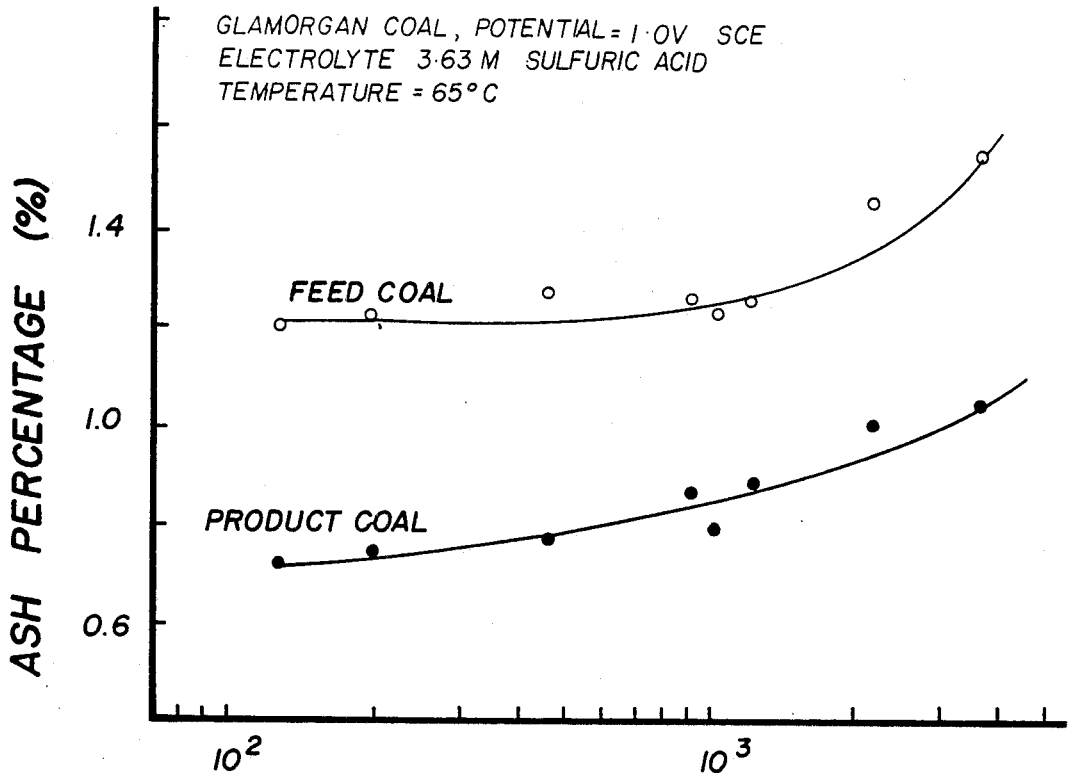
Fig. 4
Fig. 5
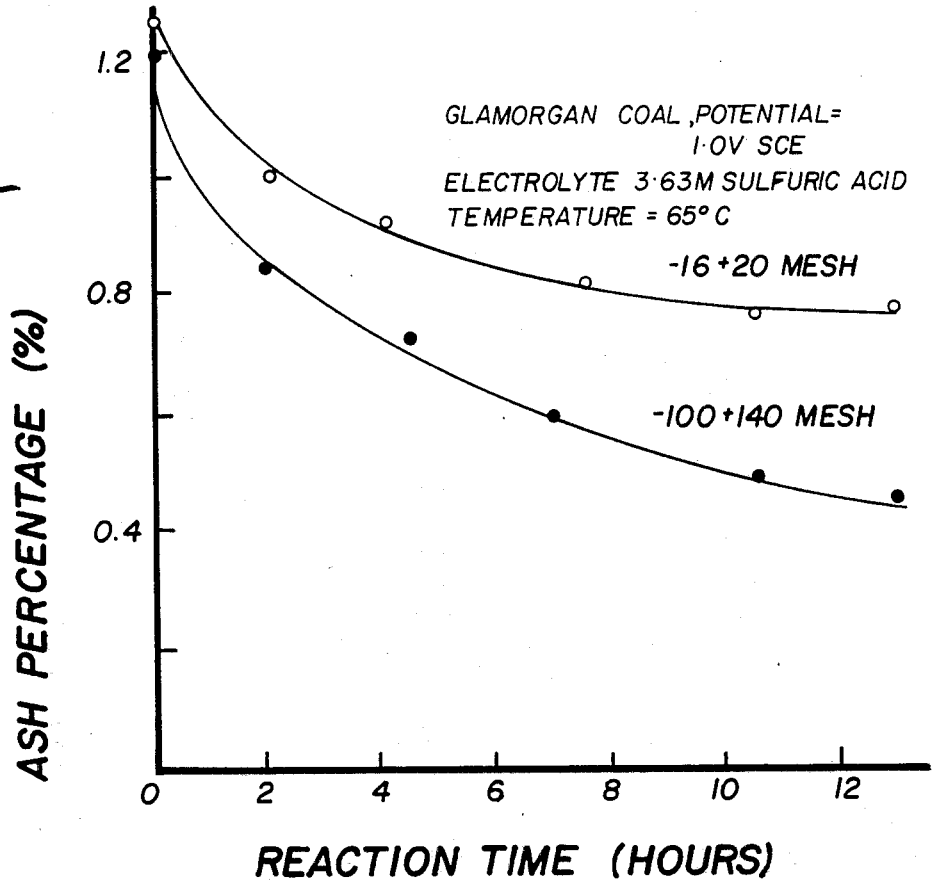

APPARATUS FOR FERRIC ION TREATMENT FOR REMOVAL OF ASH-FORMING MINERAL MATTER FROM COAL

BACKGROUND AND SUMMARY OF THE INVENTION

Coal, as mined, contains various forms of impurities including ash-forming minerals which form ash when combusted (hereinafter referred to as "ash-forming mineral matter") and inorganic (or pyritic) and organic sulfur. In order to make coal a more acceptable fuel, a significant proportion of the impurities must be removed. The conventional coal cleaning techniques, such as dense medium baths, cyclones, jigs and tables, can remove relatively coarse-grained impurities from coal without too much difficulty. However, the clean coal product from these techniques still contains a large amount of impurities typically in the 6–10% ash and 0.6–1.7% sulfur ranges. These impurities are finely disseminated in the coal matrix and, therefore require fine grinding before any separation technique can be applied to further remove them.

The objective of the grinding step is to liberate the mineral matter from the coal matrix. In some cases, the coal must be pulverized to micron sizes to achieve sufficient liberation. However, the micronizing is an energy-intensive process requiring sometimes 100 kwh or more of energy to pulverize a ton of coal. Furthermore, the size reduction frequently leads to a substantial fraction still containing "composite particles" made of both coal and mineral matter which are difficult to separate, resulting in a substantial loss of coal.

A micronized coal produced with such a large expenditure of energy is difficult to handle, and it is hard to clean it of its impurities. Many new fine coal cleaning processes have been suggested, including conventional froth flotation, microbubble flotation, selective agglomeration, selective flocculation, etc. Some of these techniques have been known to produce super-clean coal containing less than 1 or 2% ash and reduced sulfur. However, these processes suffer from relatively high consumption of reagents, difficulty in dewatering and generally low recovery, which are typical problems in processing fine particles. Chemical cleaning techniques oan produce super-clean coal from a relatively coarse coal, but it is intrinsically more expensive than the physical cleaning processes mentioned above.

The present invention suggests a new concept for cleaning coal of its mineral matter, including both the ash-forming minerals and pyritic sulfur. Meyers (U.S. Pat. No. 3,768,988) showed that pyritic sulfur can be removed substantially by treating the coal with ferric ions. In this process, the pyritic sulfur is oxidized at about 100° C. to elemental sulfur and sulfate by the ferric ions, while the ferric ions are reduced to ferrous ions. In the Meyers process, the ferric ions are regenerated from the spent ferrous ions by blowing air or oxygen at a relatively high temperature. In a similar process, Lalvani et al. (1983) showed that ferric ions can be regenerated by an electrochemical method. Both Meyers and Lalvani showed that a significant amount of pyritic sulfur is removed from the coal, but neither of these processes showed any ash-forming mineral matter removal.

SUMMARY OF INVENTION

In the present invention, a coal containing said impurities is exposed to ferric ions. To keep the ferric ions from precipitating as ferric hydroxide, an acidic condition, below approximately pH 2 or 3, is preferred. The ferric ions are reduced to ferrous ions on the coal surface, which in turn makes the coal surface slightly oxidized. Since the coal oxidation involves a loss of electrons from the coal, the surface is positively charged. It is well known that in acidic pH, most of the inorganic mineral matter is also positively charged. This creates a situation in which the ash-forming mineral matter is electrostatically repelled from the surface of the coal which helps dislodge the mineral particles from the coal surface and creates crevices or pores. If the pores are large enough, the ash-forming mineral matter dislodged as such migrates out of the coal due to electrostatic repulsion or due to the potential gradient.

If the opening of the pore is too small for the ash-forming mineral matter to migrate out, there will be a build-up of osmotic pressure inside the pore by the following mechanism. Inside the pore, the positively charged surfaces of both the coal and the ash-forming mineral matter attract counter ions such as sulfate or chloride that may be present in the system, establishing a diffuse electrical double layer. The coal becomes positively charged by the adsorption of protons and, more importantly, by the reaction of ferric ions with the sessile bonds of the coal molecule. This process results in a reduction of the chemical potential of the water inside the crevices and pores to below that of the water outside. This chemical potential difference forces the water molecules from the bulk solution into the crevices, thereby increasing the osmotic pressure. The pressure will continue to increase as long as the ferric ions react with the coal surface. Due to this pressure, the crevices of the pores of the coal open up, allowing the dislodged ash-forming mineral matter particles to migrate out of the coal matrix. Also, the breakage of the sessile bonds helps open up the pore structure. Thus, this process is essentially a liberation process induced by surface chemical reactions. An important feature of this system of ash-forming mineral matter liberation is the remarkably "sharp" separation of coal-free mineral matter particles and, thus, good recovery of clean coal in the overall process. Usually, the ash-forming mineral matter particles liberated as such from coal are of micron sizes and, therefore, can be removed by a simple screening process. Other physical cleaning processes, such as froth flotation, oil agglomeration etc., may also be used to remove the liberated mineral matter.

There are many different methods of regenerating ferric ions from the spent ferrous ions. In addition to the aforementioned aeration and electrochemical methods, micro-organisms such as Thiobacillus ferooxidans or chlorine may be used. In general, these processes are relatively inexpensive to operate and require a relatively small capital expenditure. Since a continuous supply of ferric ions is an important part of the process and since ferric ions can be regenerated cheaply, the liberation and separation process is economically attractive. A distinct advantage of this process is that the coal can be cleaned without the costly step of micronization. A relatively coarse coal, as large as ¼ inch in diameter, can be cleaned by this process to 1% ash. However the finer the coal size to be treated by this process, the less time is required to obtain a desired ash level and the lower the final ash content.

Further, the invention contemplates the utilization of a novel coal reactor in which coal particles are loosely packed in a container having first and second ends, which are closed off by porous diaphragms. An inlet chamber, including a working electrode, a reference electrode, a counter electrode and a fluid inlet, communicates with the diaphragm of the first open end of the container. The fluid outlet from the diaphragm of the second open end of the coal container communicates with the fluid inlet of the first chamber. A potential is applied to the electrodes, and electrolyte is continuously circulated into the fluid inlet, through the loosely-packed coal bed, and out the fluid outlet.

It is the primary object of the present invention to significantly reduce the ash content of coal with relatively low energy consumption and high coal recoveries (high Btu recovery. This and other objects of the invention will become clear from an inspection of the detailed description of the invention and from the appended claims.

BRIEF DESCRIPTION OF THE DRAWINGS

FIGS. 4 and 5 are graphical representations of variations of coal ash percentage with respect to other variables.

DETAILED DESCRIPTION

Figure 1:
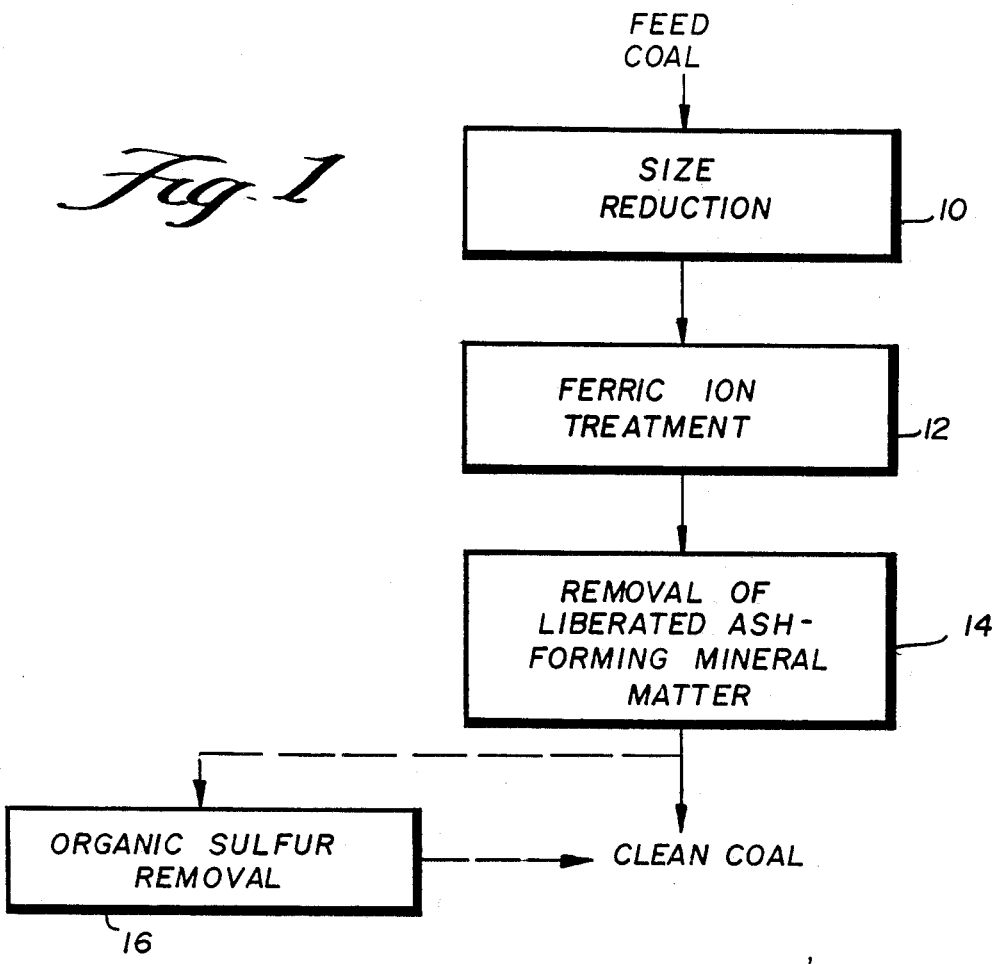
FIG. 1 is a schematic diagram illustrating the steps in the practice of an exemplary method according to the present invention.

FIG. 1 schematically illustrates an exemplary method of practicing the present invention. Feed coal, previously washed or unwashed, is fed to station 10 where it is crushed or pulverized by conventional techniques. After the size reduction, the coal is fed to a ferric ion treatment station (12), after which separation of the coal from the ash-forming mineral matter liberated during Ferric Ion Treatment is practiced (in step 14). In this step, sulfur and some of the mineral matter dissolved into solution from coal during the Ferric Ion Treatment are also removed. Additional organic sulfur treatment may take place in step 16. The coal resulting after the ash and dissolved sulfur removal (step 14) is the final clean coal product.

In the Ferric Ion Treatment stage (12), the coal particles are subjected to intimate contact with a mildly acidic medium. The exact conditions of the ferric ion treatment will depend upon the type of coal, the required ash content of the product coal and other factors. Effective process variables include coal type, particle size, contact time, temperature, type of electrolyte, applied potential, electrode material, and the concentration and relative composition of the ferrous/ferric couple.

The mechanism of the ash removal process, according to the present invention, is believed to occur as a result of the Donnan equilibrium of ions between the interior and the exterior of the pore structure of the coal. A Donnan potential is established when there is an unequal distribution of ions across a membrane or a charged surface. The coal surface is charged positively primarily by an electrochemical mechanism involving a surface oxidation of the coal coupled with a reduction of ferric ions to ferrous ions. The ferric ions can be obtained from the leaching of the pyrite in the coal in an acidic medium or added extraneously. Since the ferric ions are reduced to ferrous state during the process, the ferric ions should be continually replenished if the total iron concentration is small. The spent ferric ions can be regenerated by various methods, including the electrochemical technique. In this method, an inert electrode is placed in the coal slurry, and a potential is applied. The potential should be higher than the equilibrium potential of the ferrous/ferric couple. In addition to oxidizing the ferrous ions to ferric ions, the applied potential also serves to provide an oxidizing environment for the leaching of coal pyrite.

The mechanism of ash rejection by this process may be explained as follows. When the coal surface is superficially oxidized by the electrochemical mechanism described above, the coal surface becomes positively charged because it loses electrons to the ferric ions. It is believed that the oxidation occurs preferentially on the sessile bonds of the coal molecules, which may help to break up a part of the cross-linked coal structure and open up the pores. Since most of the ash-forming minerals are also positively charged in very acidic solutions, this charging process of the coal surface helps dislodge the ash-forming mineral matter particles from the coal surface. If the pore size is large enough, these ash-forming mineral matter particles will migrate out of the pores due to the potential gradient that exists between the interior of the pore and the bulk solution. However, when the opening of the pore is small, the ash-forming mineral matter particles cannot migrate out of the pores and, therefore, contribute to the build-up of positive charge inside the pore.

The positively-charged surfaces of coal and mineral matter cause negatively-charged ions (such as sulphate) to migrate inside the pore, setting up a Donnan potential gradient. The high concentration of ions present inside the pore reduces the chemical potential of the solvent (water) inside the pore below that of the bulk water outside the pore and forces the water molecules to migrate into the pore, creating an osmotic pressure. The pressure will continue to build up inside the pore as long as the ferric ions react with the coal surface according to the aforementioned mechanism. When the pressure is large enough, the pore structure will open up and allow the trapped mineral matter to migrate out of the coal matrix. Electron micrographs of the coal samples tested actually show the morphological changes in the processed coal. It is important to note that this process is essentially a mineral liberation process, and one can actually see the liberated ash-forming mineral matter mixed with coal particles. It is also noted here that although most of the mineral matter is removed physically by the mechanism described above, a small portion of it is removed by chemical dissolution since the process is carried out in an acidic media.

Figure 2:
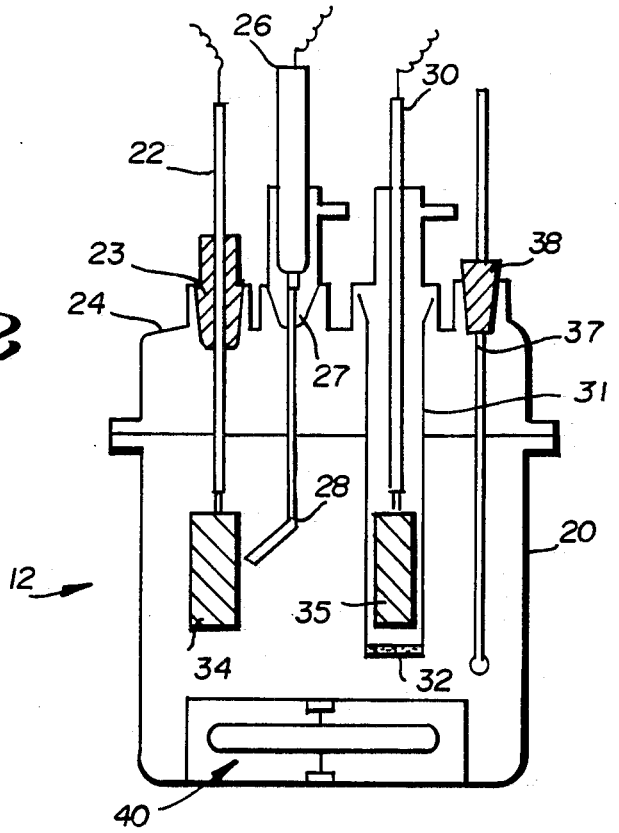
FIG. 2 is a schematic side view, partly in cross-section and partly in elevation, of an exemplary apparatus for effecting coal cleaning in an acidic medium and for regenerating ferric ions by an electrochemical method in the practice of the present invention.

FIG. 2 illustrates one exemplary form of apparatus that may be utilized to practice the Ferric Ion Treatment step (12) of FIGURE I. The apparatus of FIG. 2 comprises a water-jacketted (the water jacket is not shown) stirred reaction vessel. The temperature of the cell is maintained constant by a circulating water bath through the water jacket. The vessel (20) has a top portion (24) thereof, and a working electrode (22) is inserted through a stopper (23) in the top (24) into a slurry within the vessel (20). The reference electrode (26), disposed in chamber 27, which communicates via a Luggin capillary (28) with the interior of the vessel (20), is also operatively associated with the top (24). The counter electrode (30), disposed in the counter electrode-containing chamber (31) with the porous diaphragm (32) (e.g., glass frit) at the open bottom thereof, also extends into the vessel (20). Enlarged electrode portions (34,35) are provided at the bottoms of the working electrode (22) and counter electrode (30), respectively. A thermometer (37) may also pass through a stopper (38) in the top of the vessel, into the interior of the vessel. The coal slurry in the vessel (20) is kept in suspension by a Teflon-coated magnetic stirring bar (40) which is designed so that its spinning action does not pulverize the coal. The reference electrode (26), which preferably is a calomel reference electrode, provides a reference against which potentials are measured. In this reactor, the coal particles make contact with the working electrode. A potential (e.g., about 1 V SCE (the potential must be greater than 0.5 V SCE)) is applied to the electrodes.

Figure 3:
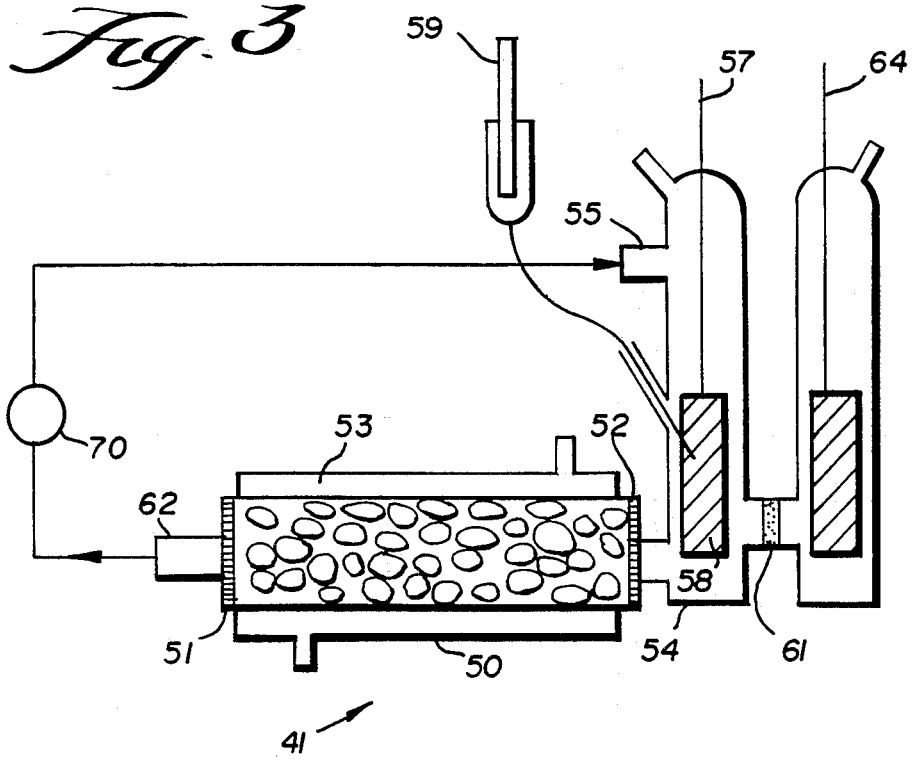
FIG. 3 is a schematic side view, partly in cross-section and partly in elevation, of an alternative exemplary construction for effecting coal cleaning in an acidic medium and for regenerating ferric ions by an electrochemical method according to the present invention.

The reactor (41) of FIG. 3 is the preferred form of reactor for treating coarser coal particles. In this reactor, the coal particles do not contact the electrode surface but, rather, a continuous flow of electrolyte through the reactor takes place. This reactor includes a container (50) which has open first and second ends closed off by porous diaphragms 51 and 52, respectively. The container (50) has a loosely-packed bed of coal particles therein and, preferably, is surrounded by a water jacket (53) to maintain the temperature therein constant.

Operatively associated with the porous diaphragm (52) at the first end of the container (50) is the inlet chamber (54), which includes a fluid inlet (55), working electrode (57) having enlarged operative portion 58 thereof, and a reference electrode (59). Operatively associated with the second diaphragm (51) is the fluid outlet (62). The counter electrode (64) is associated with the inlet chamber (54) through a glass frit (61). A pump (70) continuously circulates electrolyte from the outlet (62) to the inlet (55), past the working electrode (57), and through the coal particles in the container (50). A potential is applied to the electrodes by any suitable source.

In this embodiment, ferric ions are constantly regenerated at the working electrode, flow through the coal bed, and are subsequently reduced to the ferrous state by reaction with the coal. The ferrous ions are pumped back to the electrochemical chamber, where they are converted to ferric ions, and the process continues. The reactor (41) will normally be used for cleaning relatively coarse coal so that the particle bed formed can be porous enough to pass the electrolyte.

Figure 6:
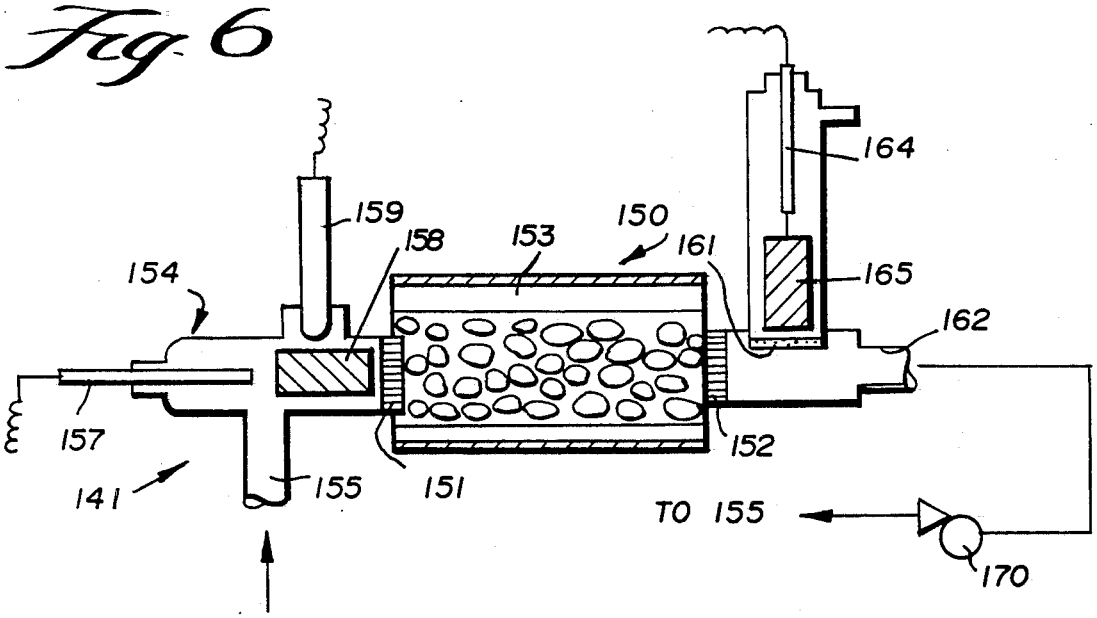
FIG. 6 is a schematic side view like that of FIG. 3, only another embodiment of the reactor according to the invention.

The embodiment illustrated in FIG. 6 is very similar to that illustrated in FIG. 3 except for the location of the counter electrode with respect to the working electrode 57. The operation is also basically the same. In the FIG. 6 embodiment, like structures are illustrated by the same reference numeral as in the FIG. 3 embodiment, only preceeded by a "1".

The ash removal stage (14) according to the present invention may comprise any suitable conventional equipment for separating the ash-forming mineral matter particles from the coal particles. If the coal particles are of size 325 mesh or greater, ash-forming mineral matter removal is preferably accomplished by utilizing conventional wet screening techniques. Alternatively, a cyclone-type separator could be utilized, possibly in combination with a microbubble flotation apparatus. Other conventional separation techniques are also utilizable, such as the oil agglomeration, selective flocculation and conventional froth flotation techniques. Essentially, in all these proposed schemes, the aforementioned costly micronizing step is replaced by the Ferric Ion Treatment step according to the present invention.

The invention will now be described with respect to several examples:

EXAMPLE 1

A coal sample from Glamorgan Coal Company, assaying 1.65% ash-forming mineral matter and 0.6% sulfur, was tested in the stirred-tank reaction vessel (FIG. 2). The experiments were carried out using a 3.63 moles/l sulfuric acid solution at 65° C. A potential of 1.0 V SCE was applied between the platinum and the calomel reference electrodes to regenerate the ferric ions. The results, given in FIG. 4, show that the ash removal improves with decreasing particle size and that a product coal assaying less than 0.8% ash can be obtained from a relatively coarse coal. Further tests were conducted by increasing the reaction time to 13 hours using a coarse (−16+20 mesh) and a fine (−100+140 mesh) fraction. As shown in FIG. 5, the ash removal improves with increasing reaction time. The ash removal curve for the coarse coal flattens out after approximately 7 hours, while that for the fine coal continues to improve after 13 hours of treatment.

Table I shows the results obtained with Glamorgan coals of finer size fractions using a 3.63 moles/l sulfuric acid solution and a potential of 1.0 V SCE at 65° C. The −140+270 mesh coal had its ash content reduced from 1.25% to 0.4% after 4 hours of treatment. The −270+325 mesh coal had its ash content reduced from 1.23% to 0.32% after 10.5 hours of treatment. Coal recoveries (i.e., recoveries of combustible material) were very high in both instances.

TABLE I

Results of the Ferric Ion Treatment Tests Conducted on Glamorgan Seam Coal

| Size (mesh) | Reaction Time (hours) | Power Consumption (kwh/ton)* | Ash (% wt) Feed | Ash (% wt) Product | Coal Recovery (% wt) |
|---|---|---|---|---|---|
| −140 + 270 | 4 | 1.8 | 1.25 | 0.40 | 98.26 |
| −270 + 325 | 10.5 | 3.83 | 1.23 | 0.32 | 97.49 |

*for regenerating spent ferric ions

The effect of different electrolytes on the removal of ash-forming mineral matter have been studied on relatively coarse fractions of Glamorgan coal. As shown in Table II, the best results were obtained when using a combination of 90% sulfuric and 10% hydrofluoric acid solutions by volume, both of 3.63 moles/l. In addition to these reagents, ferric sulfate solution was added in the amount of 1% by weight of the feed coal. After 4 hours of treatment at 80° C., the ash content was reduced from 1.28% to 0.51% with 96.2% coal recovery.

TABLE II

Effect of Various Electrolyte Combinations on the Ferric Ion Treatment of Glamorgan Coal

| Size (mesh) | Electrolyte | Temperature (°C.) | Ash (% wt) Feed | Ash (% wt) Product | Coal Recovery (% wt) |
|---|---|---|---|---|---|
| −7 + 12 | $H_2SO_4$ (3.63 M) | 60 | 1.45 | 1.06 | 98.6 |
| −20 + 60 | $H_2SO_4$ + HCl | 60 | 1.28 | 0.96 | 96.5 |
| −20 + 60 | 90% $H_2SO_4$ + 10% HF | 60 | 1.28 | 0.73 | 96.0 |
| −20 + 60 | 90% $H_2SO_4$ + 10% HF + 1% $FeSO_4$* | 60 | 1.28 | 0.57 | 96.8 |
| −20 + 60 | 90% $H_2SO_4$ + 10% HF + 1% $FeSO_4$* | 80 | 1.28 | 0.51 | 96.2 |

*% weight of coal

EXAMPLE 2

A coal sample from the Widow Kennedy seam was obtained from Wellmore Coal Company, Virginia. The −20+40 mesh fraction of the coal, assaying 23.4% ash, was treated in 3.63 moles/l sulfuric acid solution while applying a potential of 1.0 V SCE at 65° C. The working electrode used in these experiments was graphite. Table III shows the results of the two sets of experiments. In one experiment, the coal was treated continuously for 15 hours. In another, the feed coal was treated in three consecutive stages of 5, 6 and 4 hours each, for a total of 15 hours. After each stage of treatment, the coal was placed on a 40 mesh screen and sprayed with water to remove the liberated mineral matter.

TABLE III

Effect of Staged Ferric Ion Treatment on Widow Kennedy Coal

| Reaction Time (hours) | Ash (% wt) Feed | Ash (% wt) Product | Coal Recovery (% wt) |
|---|---|---|---|
| 15 | 23.4 | 8.5 | 95.53 |
| 5,6,4 | 23.4 | 3.5 | 94.64 |

The results show that the continuous treatment reduced the ash content to 8.5%, while the intermittent treatement reduced it to 3.5%. This example shows that a multi-stage treatment is advantageous for producing a lower ash coal.

In another experiment, the −3+7 mesh fraction of the Widow Kennedy coal was cleaned of its mineral matter in a laboratory scale dense medium bath to obtain 5.3% ash. The cleaned coal was treated by the present invention using the flow-through type reactor (FIG. 3). The test was carried out in sulfuric acid solutions of 2.4 and 3.63 moles/l at ambient temperature. The reaction time was 7 hours, and a potential of 1.0 V SCE was applied on a platinum electrode to regenerate the spent ferric ions. The results, given in Table IV, show that the present invention can reduce the ash to a very low level in a relatively coarse coal.

TABLE IV

Results of the Ferric Ion Treatment of Low-Ash Widow Kennedy Coal Using the Flow-Through Cell

| Sulfuric Acid Concentration (moles/l) | Ash (% wt) Feed | Ash (% wt) Product | Coal Recovery (% wt) |
|---|---|---|---|
| 2.4 | 5.3 | 1.01 | 98.25 |

TABLE IV-continued

Results of the Ferric Ion Treatment of Low-Ash Widow Kennedy Coal Using the Flow-Through Cell

| Sulfuric Acid Concentration (moles/l) | Ash (% wt) Feed | Ash (% wt) Product | Coal Recovery (% wt) |
|---|---|---|---|
| 3.63 | 5.3 | 0.99 | 98.12 |

EXAMPLE 3

In this example, a Powell Mountain coal, assaying 2.6% sulfur and 9% ash, was treated without adding any acid extraneously. The test was made in distilled water at 65° C. Ferric ions were regenerated using a graphite electrode at 1.0 V SCE. It appears that with a high sulfur coal, enough sulfuric acid and ferric ions are generated from the dissolution of the coal pyrite. The test was carried out in three successive stages with intermittent wet-screening after each stage to remove the liberated mineral matter. The filtrate from the previous test was re-used in the subsequent stages. The currents were very low in the first stage, indicating slow reaction rates. After each stage, however the currents increased, indicating an improved reaction rate due to an increased amount of ferric ions derived from the coal pyrite. The results, given in Table V, show that the ash content was reduced from 8.2% to 5.7%.

TABLE V

Results of the Cleaning of Powell Mountain Coal

| | Ash (% wt) | Sulfur (% wt) | Volatile Matter (% wt) | Btu/lb |
|---|---|---|---|---|
| Feed | 8.2 | 2.6 | 39.4 | 13,670 |
| Product | 5.7 | 2.0 | 41.3 | 14,010 |

Although the ash removal was not as significant as in the foregoing examples, this example demonstrates that the ash rejection is possible without using acids. Another significance of this example is that the present invention does not reduce the volatile matter content of the coal during processing.

EXAMPLE 4

A coal sample (−20+40 mesh) from the Middle Wyodak seam, assaying 4.7% ash and 0.44% sulfur, was tested in this example. In one experiment, the coal was treated at 66° C. for 5 hours in a standard manner using 3.63 moles/l of sulfuric acid and a potential of 1.0 V SCE on a platinum electrode. The product coal assayed 1.5% ash. In another test, a fresh coal sample was treated using the filtrate obtained from the first test. After 5 hours of reaction time, the ash was reduced from 4.7% to 1.4%. These results suggest that, in continuous operation, the reagent consumption can be minimized by recirculating the spent electrolyte.

EXAMPLE 5

A coal sample (−60+150 mesh) from the Upper Wyodak seam, assaying 8.6% ash and having a calorific value of 9,189 Btu/lb, was tested in this example. The sample was treated first in a mixture of 5% (by weight) hydrochloric and 15% sulfuric acid solutions at 65° C. using a platinum electrode at 1.0 V SCE. After 7.5 hours of treatment, the coal was placed on a 150 mesh screen and washed of its liberated mineral matter. The washed coal, containing 5.2% ash and 11,390 Btu/lb, was treated again with fresh electrolyte for another 7.5 hours under identical conditions. The ash was further reduced to 2.3%, and the calorific value was increased to 11,700 Btu/lb. This is another example showing that a multi-stage treatment is beneficial in obtaining lower ash coal. It is possible that some poisoning or passivating elements are removed during the water-washing step.

EXAMPLE 6

A Splashdam seam coal (−20+40 mesh) assaying 8.8% ash was treated at 68° C. in 1.8 and 3.6 moles/l sulfuric acid solutions. The reaction time was 6 hours, and a platinum electrode was used at a potential of 1.0 V SCE. The results, given in Table VI, show that the ash removal was improved at a higher sulfuric acid concentration.

TABLE VI

Results of Ferric Ion Treatment on Splashdam Coal at Different Electrolyte Concentrations

| Electrolyte | Ash (% wt) Feed | Ash (% wt) Product | Coal Recovery (% wt) |
|---|---|---|---|
| 1.8 M $H_2SO_4$ | 8.8 | 2.5 | 97.2 |
| 3.63 M $H_2SO_4$ | 8.8 | 1.5 | 96.2 |

EXAMPLE 7

A graphitic anthracite, containing 15% ash and 0.46% sulfur, was processed by the present invention. A particle size of −60+100 mesh was chosen for preliminary tests with the stirred-tank cell (FIG. 2). The coal was treated at 65° C. in a mixture of 5% by weight hydrochloric and 15% sulfuric acid solutions. A potential of 1 V SCE was applied to a platinum-calomel electrode pair to regenerate the ferric ions. After 3 hours of initial treatment, the coal was cleaned to 11.6% ash and 0.08% sulfur, as shown in Table VII. The cleaned coal was treated again for 9 hours to obtain a coal containing 7.6% ash and 0.02% sulfur.

TABLE VII

Effect of Reaction Time on Ash Removal from a Graphitic Anthracite

| | Reaction Time (hours) | Product (% wt) Ash | Product (% wt) Sulfur | Btu/lb | Coal Recovery (% wt) |
|---|---|---|---|---|---|
| 1st stage | 3 | 11.6 | 0.08 | 11,903 | 96.2 |
| 2nd stage | 9 | 7.6 | 0.02 | 12,243 | 94.3 |

EXAMPLE 8

A refuse filter cake from Glamorgan Coal Company, assaying 44% ash was treated by the present invention. The coal sample was processed as received, so that it contained a large amount of fines. The electrolyte solution consisted of 5% hydrochloric acid and 15% sulfuric acid by weight. A potential of 1.0 Y SCE was applied on a platinum electrode in the stirred-tank reactor (FIG. 2). After 4 hours of treatment at 65° C. the processed coal was washed of its liberated ash in a 400 mesh screen and an final product assayed 9.3% ash and 13,900 Btu/lb. The recovery was only 52.1% because much of the fine coal passed through the screen. A higher recovery would have been obtained if the processed coal had been cleaned of its liberated mineral matter using a process such as froth flotation or oil agglomeration.

EXAMPLE 9

An Upper Freeport coal (−28 mesh×0), assaying 24.5% ash and 1.68% sulfur, was treated in 2 moles/l hydrochloric acid solution for 5 hours using the stirred-tank reactor (FIG. 2). The ferric ions were regenerated on a platinum electrode at 1.0 V SCE.

After the initial 5-hour treatment the processed coal was washed of its liberated mineral matter in a 400 mesh screen. The cleaned coal, obtained as such, assayed 7.7% ash and 0.64% sulfur, as shown in Table VIII. The recovery was relatively low (65%) because a significant amount of the fine coal particles passed through the screen along with the liberated mineral matter. The cleaned coal was treated in the second stage in the same manner; the ash content was further reduced to 3.7%, but the sulfur content remained about the same. The coal reoovery was high (86%) because most of the fines had already been removed in the first stage.

TABLE VIII

Results of Ferric Ion Treatment on Upper Freeport Coal

| | Reaction Time (hours) | Product (% wt) Ash | Product (% wt) Sulfur | Coal Recovery (% wt) |
|---|---|---|---|---|
| 1st stage | 5 | 7.7 | 0.64 | 65 |
| 2nd stage | 5 | 3.7 | 0.63 | 86 |

EXAMPLE 10

The same Upper Freeport coal used in Example 9 was processed in combination with froth flotation and the microbubble flotation process. The −28 mesh×0 coal was subjected initially to froth flotation using a Denver laboratory flotation machine. After two stages of flotation, consuming 1.0 lb/ton of kerosene and 0.2 lb/ton of Dowfroth M-150, a clean coal product assaying 4.8% ash with 82.8% recovery was obtained. The clean coal product was pulverized for 15 minutes in an attrition mill to liberate the mineral matter in a conventional way. The mill product was subjected to four stages of microbubble flotation, consuming a total of 1.0 lb/ton of kerosene and 4.0 lb/ton of Dowfroth M-150. The ash content of the coal has reduced to 1.8% with 73.2% recovery.

The cleaned coal product from the microbubble flotation was subjected to the invented process. It was treated in 2.0 moles/l hydrochloric acid solution for 4 hours under the same conditions as described in Example 9. After the treatment, the coal slurry was subjected to single-stage microbubble flotation using 1.0 lb/ton of kerosene and 0.6 lb/ton of Dowfroth M-150. The cleaned coal product, obtained as such, assayed 1.16% ash and the coal recovery was 82% for the microbubble flotation alone and 60% overall including conventional flotation, ferric ion treatment and microbubble flotation processes.

EXAMPLE 11

In the examples presented heretofore, the spent ferric ions were regenerated by oxidizing the ferrous ions on the surface of a graphite or platinum electrode; the potentials of the electrodes were set above the equilibrium potential of the oxidation reaction. It was considered, however that as long as there is a sufficient amount of ferric ions present in the system, the Ferric Ion Treatment process can be effective without the use of the electrode and applied potential. To demonstrate this effect a set of experiments have been carried out using a relatively high concentration (26.6% by weight) of hydrated ferric sulfate ($Fe_3(SO_4)_2.nH_2O$) alone. No attempts have been made to regenerate the spent ferric ions during the treatment, and no acids were used.

Coal samples from Norton seam, Splashdam seam and Blair seam have been used. In each test, a 20-gram sample was mixed with 100 ml of the ferric sulfate solution and left in a water bath at 60° C. To prevent the breakage of the coal particles, no mechanical stirring was applied, except for occasional agitation by hand. After 12 hours of treatment, the coal sample was wet-screened by hand using plenty of tap water. The liberated ash particles passed through the screen while the coal particles were retained on the screen; the Norton seam coal was washed using a 230 mesh screen while the Splashdam and Blair seam coals were washed using a 200 mesh screen.

The clean coal products remaining on the screen were then subjected to a simple skin flotation experiment in which the coal particles floating on the surface of the water were carefully skimmed off and analyzed. The results are given in Table IX. As shown, the Ferric Ion Treatment process can be effective without applying potentials to the slurry by means of an electrode.

TABLE IX

Results of Ferric Ion treatment Without Regenerating the Spent Ferric Ions

| | Norton Seam (−100 + 230 mesh) | | Splashdam Seam (−80 + 200 mesh) | | Blair Seam (−140 + 200 mesh) | |
|---|---|---|---|---|---|---|
| Product | Ash (% wt) | Coal Recovery (% wt) | Ash (% wt) | Coal Recovery (% wt) | Ash (% wt) | Coal Recovery (% wt) |
| Float | 3.3 | 14.7 | 1.8 | 34.3 | 1.2 | 50.7 |
| Screen | 12.68 | 71.4 | 2.5 | 92.5 | 1.7 | 99.3 |
| Feed | 16.9 | 100.0 | 3.6 | 100.0 | 2.0 | 100.0 |

It has, thus, been seen that according to the present invention, ashforming mineral matter can be removed from a coal in a simple, effective, and energy-efficient manner. While the invention has herein been shown and described in what is presently conceived to be the most practical and preferred embodiment thereof it will be apparent to those of ordinary skill in the art that many modifications may be made thereof within the scope of the invention, the scope of which is to be accorded the broadest interpretation of the appended claims so as to encompass all equivalent methods products, and apparatus.

What is claimed is:

1. A reactor comprising:

a container having first and second open ends and adapted to be packed with particles;

a porous diaphragm disposed at each of said first and second open ends of said container;

an inlet chamber operatively connected to said first open end of said container, said inlet chamber including a working electrode, a reference electrode, a counter electrode behind another diaphragm, and a fluid inlet;

an outlet operatively connected to said second open end of said container through which electrolyte solution is transferred back to the inlet chamber; and means for supplying an electrical potential to said electrodes.

2. A reactor as recited in claim 1 wherein said working electrode and said counter electrode include enlarged electrolyte-engaging portions which are of material selected from the group consisting essentially of graphite, platinum foil, and platinum mesh.

3. A reactor as recited in claim 1 wherein said container is packed with coal particles.

4. A reactor as recited in claim 1 further comprising pump means for recirculating electrolytic solution from said outlet to said inlet chamber.

5. A reactor as recited in claim 1 wherein said counter electrode, and said diaphragm behind which said counter electrode is disposed, are mounted on the opposite side of said working electrode from said container first open end.

6. A reactor comprising:

a container having first and second open ends and adapted to be packed with particles;

a porous diaphragm disposed at each of said first and second open ends of said container;

an inlet chamber operatively connected to said first open end of said container, said inlet chamber including a working electrode and a reference electrode, and a fluid inlet;

an outlet operatively connected to said second open end of said container through which electrolyte solution passes from said container back to said inlet chamber, said outlet including a counter electrode, mounted behind a diaphragm, in operative association therewith;

means for supplying an electrical potential to said electrode; and means for circulating electrolyte solution from said outlet to said inlet chamber.

* * * * *